US010774627B1

(12) United States Patent
Lea, Jr.

(10) Patent No.: US 10,774,627 B1
(45) Date of Patent: Sep. 15, 2020

(54) ADJUSTING SPEED DURING BEAM PUMP CYCLE USING VARIABLE SPEED DRIVE

(71) Applicant: James F. Lea, Jr., Lubbock, TX (US)

(72) Inventor: James F. Lea, Jr., Lubbock, TX (US)

( * ) Notice: Subject to any disclaimer, the term of this patent is extended or adjusted under 35 U.S.C. 154(b) by 262 days.

(21) Appl. No.: 15/205,215

(22) Filed: Jul. 8, 2016

(51) Int. Cl.

| | |
|---|---|
| ***F04B 49/20*** | (2006.01) |
| ***F04B 47/02*** | (2006.01) |
| ***E21B 47/009*** | (2012.01) |
| ***E21B 43/12*** | (2006.01) |

(52) U.S. Cl.
CPC ..... *E21B 43/127* (2013.01); *E21B 47/009* (2020.05); *F04B 47/022* (2013.01); *F04B 49/20* (2013.01)

(58) Field of Classification Search
CPC ..... E21B 2043/125; E21B 43/126; E21B 43/127; E21B 47/0008; F04B 49/20; F04B 47/022
See application file for complete search history.

(56) References Cited

U.S. PATENT DOCUMENTS 4,541,274 A * 9/1985 Purcupile ..... E21B 47/0008 166/105
4,973,226 A * 11/1990 McKee ..... E21B 47/0008 417/18
2006/0067834 A1* 3/2006 Boyer ..... F04B 47/02 417/44.1
2008/0240930 A1* 10/2008 Palka ..... E21B 43/127 417/42
2010/0111716 A1* 5/2010 Gibbs ..... F04B 49/065 417/63
2013/0306326 A1* 11/2013 Doyle ..... E21B 43/127 166/369
2017/0002805 A1* 1/2017 Williams ..... F04B 49/20

OTHER PUBLICATIONS

Lea, Non-published parent application, U.S. Appl. No. 14/546,919.

* cited by examiner

*Primary Examiner* — Robert E Fuller
(74) *Attorney, Agent, or Firm* — James F. Lea, III; Gable Gotwals

(57) ABSTRACT

A well has a wellbore extending from a surface. Tubing extends within the wellbore for supporting a downhole pump. Sucker rods extend within the tubing for reciprocating a travelling valve. A load calculator determines loading on the sucker rods during a pump cycle. A variable speed driver reciprocates the sucker rods and travelling valve. A real time speed controller varies a speed of the driver in response to loading information from the load calculator for smoothing the rod load in a beam pump cycle. A target rod load is obtained and a surface linear speed of rods is varied by either slowing or speeding a driver for varying a surface linear speed of the rods when rod loading is above or below the target rod load.

13 Claims, 5 Drawing Sheets

40
TYPICAL SURFACE DYNAMOMETER CARD 14000
12000
10000
8000
6000
4000
2000
0
LOAD, Lbfs
A
B
C
D
0
1
2
3
4
5
POSITION, ft

% LOAD CHANGE ABOUT AVERAGE LOAD SELECTED 15
10
5
0
-5
-10
-15
% LOAD OF AVERAGE SELECTED LOAD
0.0
0.5
1.0
1.5
2.0
2.5
3.0
3.5
4.0
4.5
POSITION, ft

ADJUSTING SPEED DURING BEAM PUMP CYCLE USING VARIABLE SPEED DRIVE

FIELD OF THE INVENTION

The invention relates to a method for smoothing rod loading in a beam pump cycle. More particularly, the invention relates to a method for adjusting the speed of a prime mover during a complete pump cycle of a beam pump using a variable speed drive.

BACKGROUND OF THE INVENTION

Referring to FIG. 1, a beam pump or pumpjack, designated generally as 10, is the mechanical drive that converts rotary motion of a motor or prime mover 12 to reciprocating motion for reciprocating a downhole piston pump 14 in an oil well. Sucker rods 16 join the surface components of beam pump 10 and the downhole piston pump 14. Downhole pump 14 typically includes a pump barrel 17, which contains a plunger 21 carrying a travelling valve 18, and a standing valve 20. Beam pump 10 is used to mechanically lift liquid out of a well if there is insufficient bottom hole pressure for liquid to flow all the way to the surface. Beam pump 10 may also be used to increase the current production from a low producing well. Beam pumps, such as beam pump 10 of FIG. 1, are commonly used for low producing onshore wells and are common in oil-rich areas. About 60% of all artificially lifted wells in North America are beam or sucker rod pump systems and the figure is closer to 70% worldwide.

Depending on the size of beam pump 10, production may be from 15 to 30 liters of liquid per stroke, depending on design parameters. Often, the produced fluid is a mixture of crude oil and water with the possibility of some gas. Pump unit size, the size of sucker rods 16, and the horsepower capability of prime mover 12 are selected to accommodate the depth and weight of the oil to be removed. Deeper extraction requires greater power to move the increased weight of the discharge column. The diameter of downhole pump 14 and stroke length of the surface unit of beam pump 10, along with the pumping speed, i.e., strokes per minute (SPM), determine the producing rate of liquids. Liquids are routed up tubing string 24.

Beam pump 10 converts the rotary motion of a pump motor 12 to a vertical reciprocating motion to drive sucker rods 16, which are connected to the piston pump or downhole pump 14. The vertical reciprocating motion of beam pump 10 produces the characteristic nodding motion of the pump, which may be referred to as a walking beam.

A surface dynamometer card is the plot of measured or predicted surface loads on rods 16 of the pump shaft, i.e., sucker rods, at various positions throughout a complete stroke of beam pump 10. Surface loads may be measured via a load cell, e.g., located under a rod clamp resting on a carrier bar. Alternatively, a predicted surface load may be obtained from a predictive wave equation computer program, as is known in the art. For purposes of this application, a load cell, or other load measuring device, as well as computer or software that calculates surface load, shall be referred to as a load calculator. A surface dynamometer card reflects forces at the surface but can also be used to calculate and to plot forces in rods 16 above downhole pump 14 or anywhere in the string of sucker rods 16 as a function of position at the bottom of rod string 16 or anywhere in rod string 16. The loads on the surface card or loads in the rods 16 at the surface are a result of the fluid load and also are a result of the weight of rods 16 in fluid and dynamic forces.

The load is typically displayed in pounds of force (Y scale) and the position (X scale) of a rod is typically displayed in inches. Dynamometer cards are displayed by predictive and diagnostic software for the purposes of design and diagnosis of sucker rod pumping systems to show stroke length, maximum/minimum loads for a cycle and other parameters.

Some diagnostics may be conducted by an analysis of surface dynamometer card shapes, since certain downhole problems are typically associated with particular surface dynamometer card shapes. In shallow to medium depth wells, such interpretation of the surface dynamometer card may be reasonably effective in diagnosing pump performance. In deeper wells, however, the complex nature of the lift system means that diagnosing pump performance from surface dynamometer cards can be more problematic due to the dynamics of the long string of sucker rods.

A downhole dynamometer card, designated generally 30 (FIG. 2), is a plot of calculated loads at various positions of pump stroke and represents the fluid load that pump 14 applies to the bottom of the rod string 16. Downhole dynamometer card 30 has four indices, i.e., A, B, C, and D, representing opening and closing events of standing valve 20, i.e., indices B and C, and opening and closing events of travelling valve 18, i.e., indices A and D. A schematic of pump 12 is shown adjacent to each labeled corners A-D of card 10 wherein the status of pump 14 at each of points A-D is shown. The maximum plunger travel (MPT) is the maximum length of the movement of plunger 21 with respect to barrel 17 of pump 14 during one complete stroke. Most of the load, presented on the Y-axis of downhole dynamometer card 30, is a force caused by differential pressure acting on plunger 21 of pump 14 or the fluid load at pump 14. The differential pressure acts across traveling valve 18 on the upstroke and is transferred to standing valve 20 on the down stroke. The differential pressure is the difference between the pressure due to fluids within tubing 24 and the pressure in the wellbore. The magnitude of the fluid load is equal to the pump discharge pressure minus the pump intake pressure multiplied by the plunger area. Loads are shown on a downhole dynamometer card 30 on the Y scale, i.e., load in rod 16 above pump 14, and position of rods 16 above the pump 14 (X scale) will be transferred to a surface dynamometer card along with the weight of rods 16 in fluid and dynamic loads. A typical surface dynamometer card 40 is shown in FIG. 3.

Still referring to FIG. 2, the successive steps in the downhole pump operation include the following: At the start of the upstroke (point A), traveling valve 18 and standing valve 20 are both closed.

Still referring to FIG. 2, from points B to C, rods 16 carry the fluid load when traveling valve 18 is closed. From points D to A, tubing 24 carries the fluid load, when standing valve 20 is closed. The effective plunger travel (EPT) is the length of travel of plunger 21 when the full fluid load is acting on standing valve 20. In FIG. 2, the effective travel of plunger 21 is from B to C and is usually a smaller length than the surface stroke length due to stretch of rods 16.

Referring now to FIG. 3, a typical surface dynamometer card is shown. A surface dynamometer card is a plot of measured loads on rods 16 at various positions throughout a complete stroke. The load may be displayed in pounds of force and the position may be displayed in inches. With reference to surface dynamometer card 40, from point A to point B, the fluid load is fully carried by tubing 24 prior to point A and is gradually transferred rods 16 at point B. The load transfers as rods 16 are loaded and exhibit stretch to pick up the fluid load. If tubing 24 is anchored, plunger 21 and travelling valve 18 do not move relative to tubing 24. Pressure in pump 14 decreases and any free gas in the clearance space between valves 18 and 20 expands from the static tubing pressure ($P_t$) to the pump intake pressure ($P_{int}$).

Standing valve 20 begins to open at A, allowing fluid to enter pump 14 when the pressure in pump 14 drops below the intake pressure ($P_{int}$).

Still referring to FIG. 3, with reference to surface dynamometer card 40, from point B to C, the fluid load is carried by rods 16 as well fluids are drawn into pump 14. At C, standing valve 20 closes as plunger 21 starts down, and traveling valve 18 remains closed until the pressure inside pump 14 is slightly greater than the pump discharge pressure ($P_d$). From C to D, gas in pump 14 (if present) is compressed as plunger 21 moves down to increase pressure on the fluid from the intake pressure ($P_{int}$) to the static pressure in tubing 24. However, plunger 21 does not move if pump barrel 17 is full of an incompressible fluid. As fluid in pump barrel 17 is compressed, then the fluid load is gradually transferred from rods 16 to the tubing 24.

At D, the pump discharge pressure ($P_d$) equals the static tubing pressure ($P_t$), and traveling valve 18 opens. From D to A, fluid in pump 14 is displaced through traveling valve 18 into tubing 24 and the fluid load is held by tubing 24.

SUMMARY OF THE INVENTION

In one embodiment, the method of the invention relates to a method and apparatus for adjusting inner cycle speed control of a pump motor to smooth rod loading and to possibly reduce rod loading, to reduce energy consumption and reduce gearbox loading.

The method for smoothing rod load in a beam pump cycle includes the steps of monitoring a surface linear speed of rods and controlling the rod speed by adjusting the motor speed to slow when peaks in rod loading are present and to accelerate when valleys in rod loading are present. In one embodiment, an average loading of the rods in the upstroke portion of the pump cycle is determined. In another embodiment, the step of varying the surface linear speed is used to smooth loading of said rods in a down stroke portion of the pump cycle.

In one embodiment, the motor is used to vary the linear speed of the rods such that the linear speed of the rods is adjusted by a percentage amount that is inversely proportional to percentage variations in load of said rods about the selected average of loading. The step of varying the linear speed of the rods is preferably accomplished by an instantaneous speed variation of a driver responding to instructions programmed into a variable speed controller.

In one embodiment, the step of varying the surface linear speed inversely proportional to rod loading changes in an upstroke and/or in a down stroke are made proportionally larger or smaller related to the changes in said rod loading during a pump cycle to obtain best results in smoothing a dynamometer card.

Variations in rod loading may be used to implement instantaneous variations in said surface linear speed of the rods, wherein the surface linear speed of the rods are controlled by a variable speed drive and wherein the variations are controlled within a cycle rather than effecting an overall speed change for an entire cycle.

Rod loads may be averaged across an upstroke portion of a dynamometer card or over a portion of the dynamometer card where loading of the rods varies and is close to peak loading and the surface linear speed is controlled with a variable speed drive, e.g., by a variable speed controller in operative communication with the prime mover, to control minimum loads, i.e., if minimum loads spike downward, then at this location a reduction in downstroke linear speed could be implemented using the method of the invention.

The minimum load on the rods during the down stroke may be represented by "MPRL". The peak load on the rods during upstroke may be represented by PPRL. If MPRL/PPRL is greater than a desired value, e.g., is greater than 0.2 or 20%, or another selected threshold value, a design or application can be expected to have an increased run life. In particular, the run life of the sucker rods can be expected to increase. The method of the invention may be used to ensure that the MPRL/PPRL ratio is approaching desired values.

DETAILED DESCRIPTION OF THE PREFERRED EMBODIMENTS

The method of the invention includes the steps of developing a fluid load target in the cycle of a beam pump operation. The pump motor speed is varied to smooth erratic loads, thereby possibly reducing rod loading, gearbox loading, and energy consumption. The peaks in the surface card are considered to be from dynamic forces and it is thought that slower vertical speed in the areas of initial peak loading should reduce dynamics in the rod string and reduce the peaks in the loading.

Figure 3:
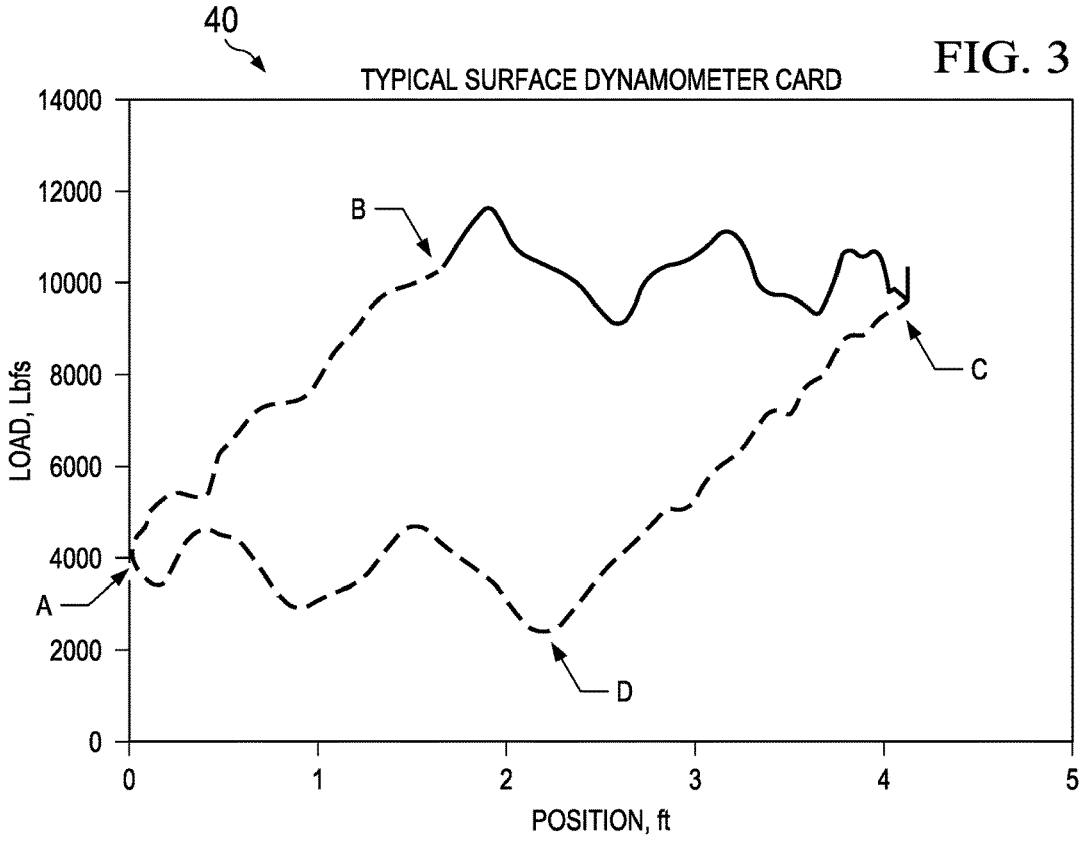
FIG. 3 shows a typical surface dynamometer card from a beam pump installation showing loads on a fluid plunger of a beam pump at positions of a beam pump stroke.

Referring now to FIG. 3, a typical surface dynamometer card 40 is shown. An ideal surface card would show a parallelogram. However, dynamic forces in the long string of rods 16 create loads shown at the top and bottom of card 40 that result in the peaks and valleys that can be seen on the top of card 40 (the upstroke portion designated by segment B-C) and on the bottom of the card (the downstroke portion of the pump cycle designated by segment D-A).

To smooth loading of pump 14, a rough average of the surface up/down loads across the top of the card, i.e., across segment B-C, is determined, e.g., an approximately 10,000 pound load in FIG. 3. In one embodiment, the load average is estimated visually by a user. The load average could additionally be established via a computer analysis or by other methods. The selection of 10,000 pounds in the example of FIG. 3 is achieved by drawing a horizontal line across the top of the card. However, loads may be also determined by selecting an inclined line with load variations above and below the line as opposed to the horizontal line that is more suited for the example of FIG. 3.

Figure 4:
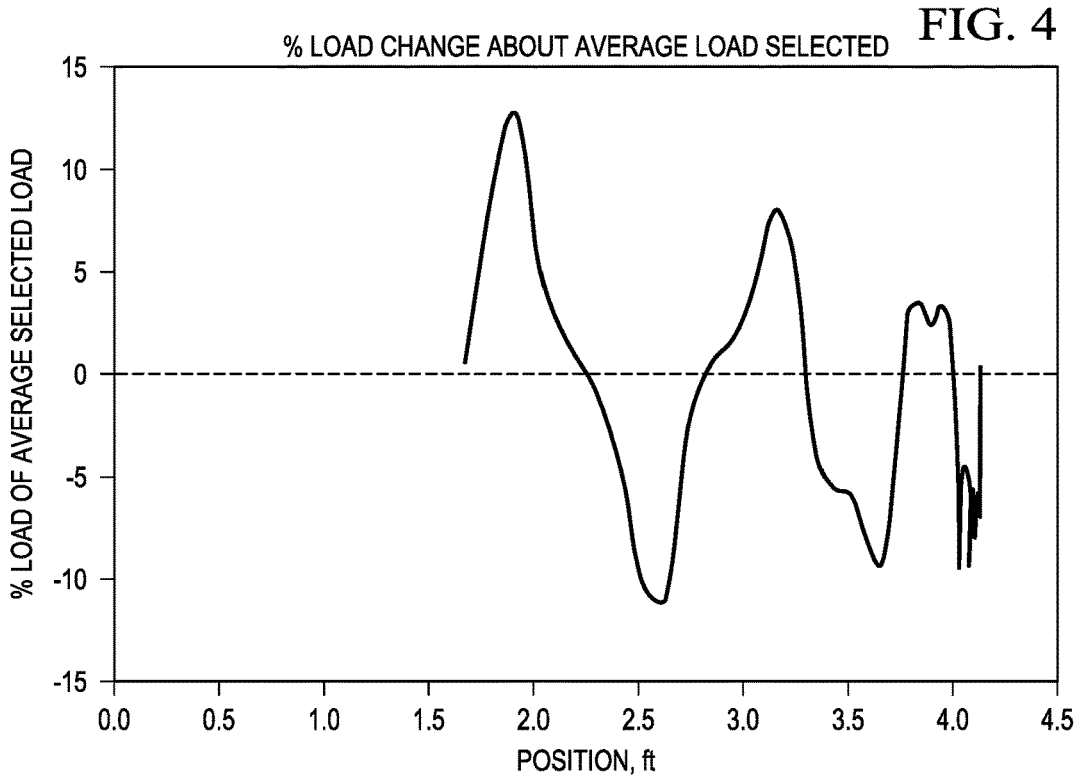
FIG. 4 shows a percentage change of loads deviating from a selected average for the portion of the stroke between two points selected on the top of the card corresponding to a portion of the upstroke.

Next, a percentage of change of the loads from the selected average is calculated. As shown in FIG. 4, the percentage load change about an average selected load may be plotted.

Figure 5:
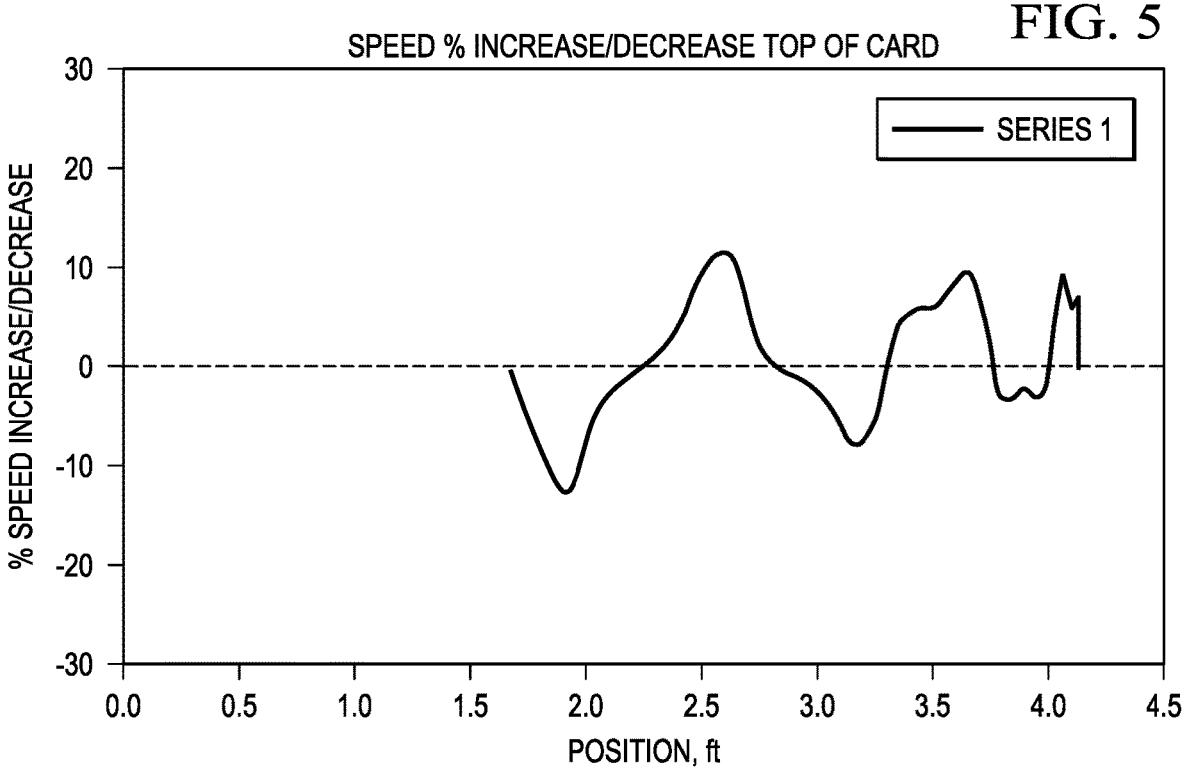
FIG. 5 shows a suggested change in motor speed corresponding to the portion of the upstroke selected in FIG. 4.

One object of the invention is to slow the speed of prime mover 12 when load peaks occur and to increase the speed of prime mover 12 during period of low load, i.e., when there are load valleys. The speed of prime mover 12 may be varied by percentages in an inverse relationship to the percent load changes, which results in making suggested speed changes of the same percentage as the load variations but of an opposite value to the load changes. FIG. 5 shows a plot of suggested speed variations of prime mover 12.

Figure 6:
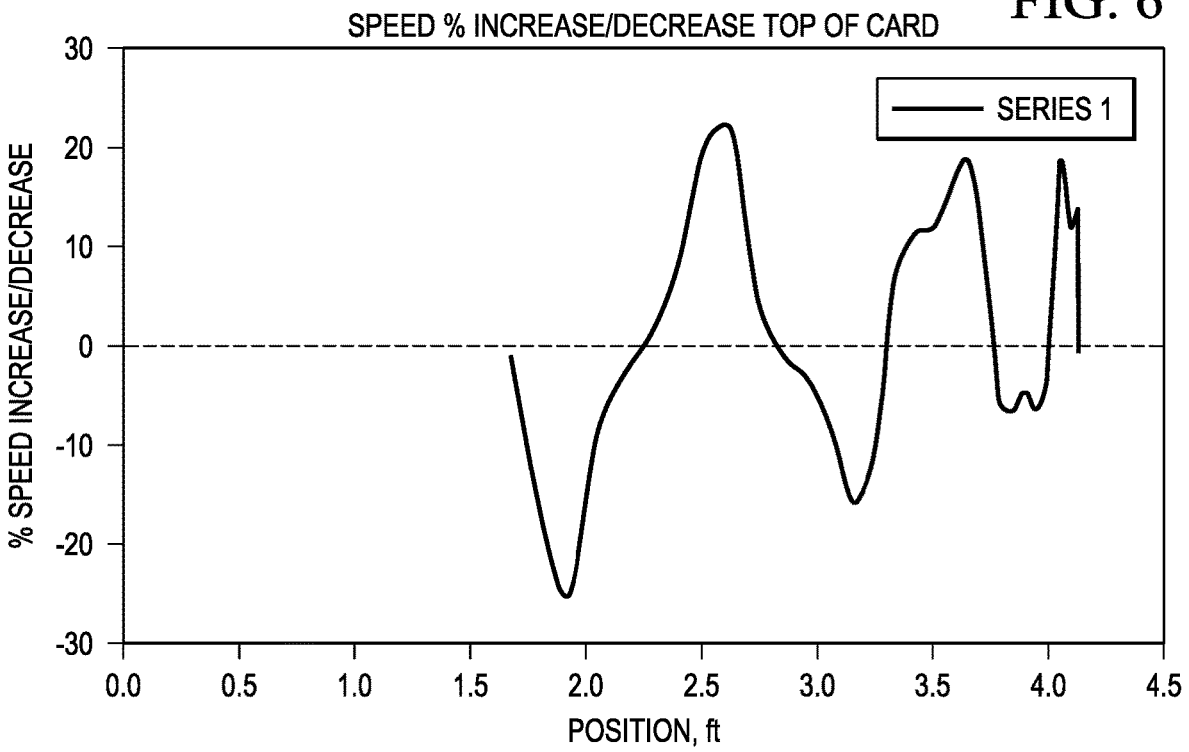
FIG. 6 shows an alternate suggested change in motor speed corresponding to the portion of the upstroke selected.

A greater change in speed of prime mover 12 than the 1:1 percentage variation discussed above may be required to smooth the top of the dyno card 40, i.e., to smooth segment B-C of card 40. Therefore, motor speed variance may be multiplied by a factor, e.g., by 2. A plotted example result is shown in FIG. 6. Motor speed variance may be multiplied by another selected factor as well, e.g., 2.5, 3, or another factor.

Figure 7:
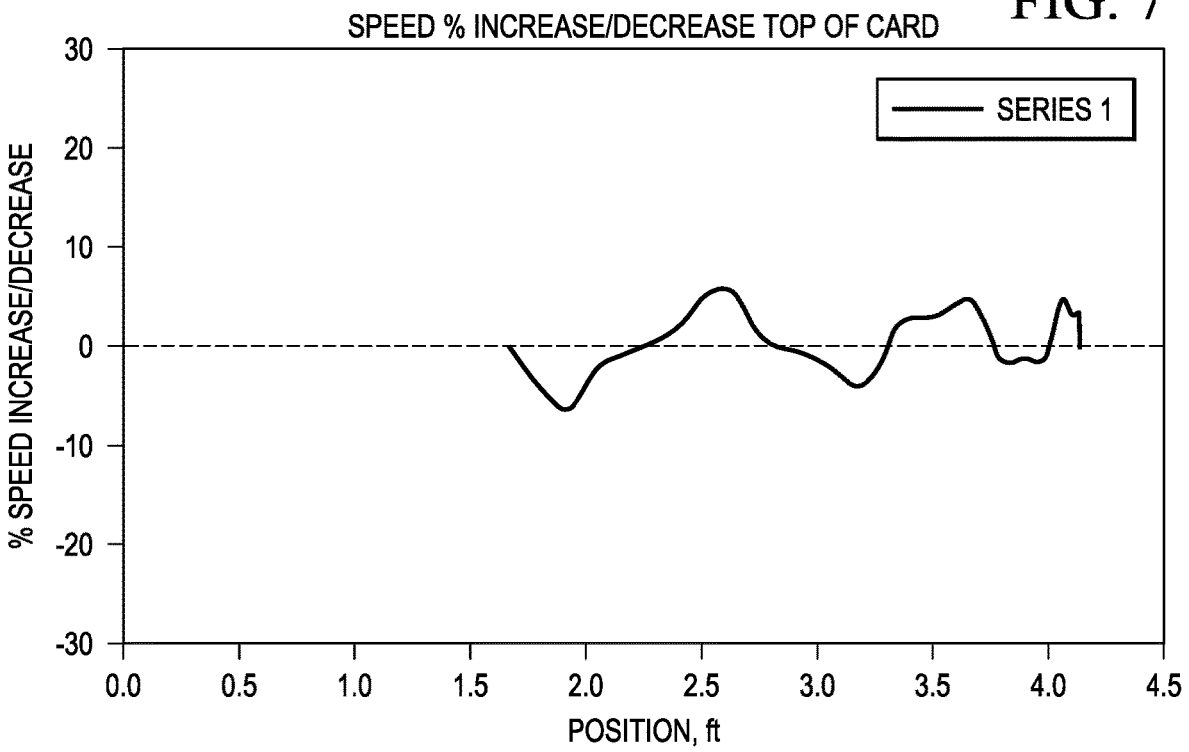
FIG. 7 shows a second alternate suggested change in motor speed corresponding to the portion of the upstroke selected.

A lower percent change in speed may also be desired. Therefore, the 1:1 percentage speed variation discussed above may be multiplied by a factor of less than one, e.g., by 0.5, as shown in FIG. 7, or by another factor such as 0.25, 0.33 or another factor.

The same technique can be used to determine a target for the varying loads and speeds across the bottom, or the down stroke portion, i.e. segment D-A, of dynamometer card 40.

Note that the above description is of a surface card, which could be more accurately developed by measurements of load and position at the surface from a "predictive" card at the surface. However, if a surface measured card is available, the surface measured card can be input into a "diagnostic" program and a dynamometer card can be calculated down rod string 16 to obtain a card for the loads/positions in rods 16 just above pump 14. As this is being done, intermediate dynamometer cards in rod string 16 may be calculated by the "diagnostic" card. Typically, intermediate dynamometer cards are not displayed but easily can be. Therefore, since the intermediate dynamometer cards are available, then the techniques described above for guiding a user with regard to changes in the speed of the unit could be applied to intermediate cards and not just to the surface card. For example, the techniques could be applied to determine speed control for a card calculated by a diagnostic program, e.g., at a location half way down the rod string. Therefore, the technique is not limited to being applied to only the surface card. In an alternate embodiment, intermediate cards can be extracted from a "predictive" design program and, as such, the same techniques could be applied to an intermediate card obtained from a "predictive" program.

Figure 1:
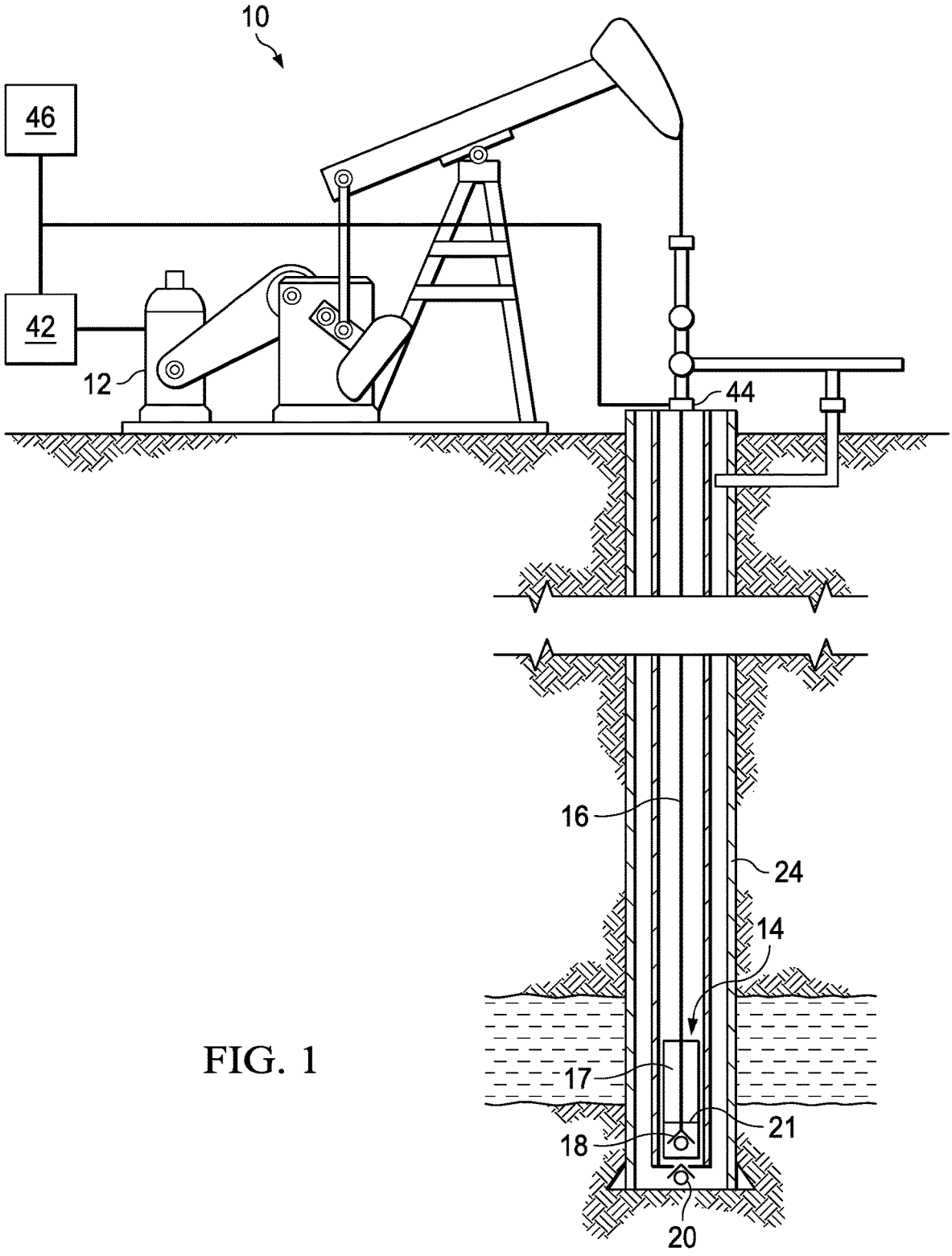
FIG. 1 is a schematic of a beam pump deployed in a well.
Figure 2:
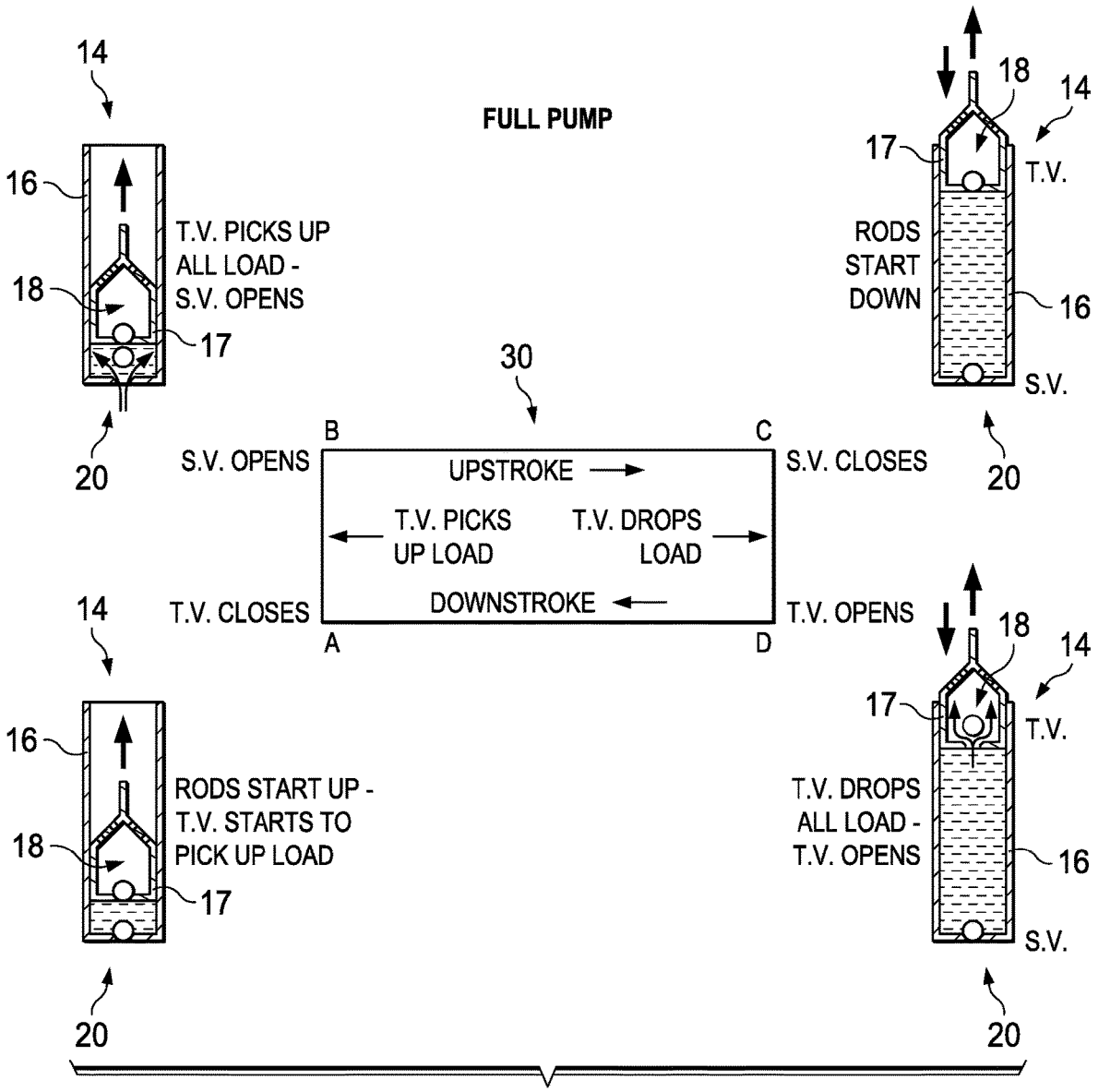
FIG. 2 shows a typical downhole dynamometer card and associated events of a pump cycle for a downhole pump that is completely fluid filled.

By using the method of the invention, a user is provided with a target that may be implemented in a program for directing a variable speed drive, e.g., via a variable speed controller 42 in operative communication with prime mover 12, for inner cycle speed control. Alternatively, variable speed controller 42 may be integral with prime mover 12. Variable speed controller 42 receives load information from load cell 44 (FIG. 1), from computer 46 running a predictive wave equation computer program, or from other sources. The magnitude of the percent changes in speed can be adjusted for best smoothing of the surface dyno card and for possible reductions in rod loading, energy consumption, and gear box loading.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method for smoothing rod load of rods in a rod string during a beam pump cycle, the method comprising the steps of:

generating a dynamometer card of the beam pump cycle;

selecting a horizontal or inclined line over a top or bottom of said dynamometer card, said horizontal or inclined line comprising a target rod load;

measuring rod load to obtain a measured rod load;

comparing said measured rod load against said target rod load; and in response to said comparing, instantaneously varying a driver speed for varying a surface linear speed of said rods by sending instructions from a variable speed controller to the driver to perform at least one of slowing the driver when said measured rod load is above said target rod load and speeding the driver when said measured rod load is below said target rod load.

2. The method according to claim 1 wherein:

said step of varying the surface linear speed is used to smooth loading of said rods in an upstroke.

3. The method according to claim 1 wherein:

said step of varying the surface linear speed is used to smooth loading of said rods in a downstroke.

4. The method according to claim 1 wherein:

said step of varying said surface linear speed occurs within the beam pump cycle rather than effecting an overall speed change for an entire cycle.

5. The method according to claim 1, further comprising:

measuring a minimum load on the rods (MPRL) during a downstroke of said rod string and measuring a peak load on the rods (PPRL) during an upstroke of the rod string;

calculating a ratio of MPRL to PPRL;

comparing said ratio to a desired value; and adjusting said ratio by adjusting a speed of the driver to achieve said desired value.

6. The method according to claim 1 wherein:

said dynamometer card is a predictive card.

7. The method according to claim 1 wherein:

said dynamometer card is a surface measured card.

8. The method according to claim 1 wherein:

said step of comparing comprises calculating a percentage variation of said measured rod load above or below said target rod load; and said step of instantaneously varying said surface linear speed comprises adjusting said surface linear speed by a percentage amount equal to said percentage variation.

9. The method according to claim 1 wherein:

said step of comparing comprises calculating a percentage variation of said measured rod load above or below said target rod load; and said step of instantaneously varying said surface linear speed comprises adjusting said surface linear speed by a percentage amount equal to said percentage variation multiplied by a factor.

10. A method for smoothing rod load of rods in a rod string during a beam pump cycle wherein said beam pump cycle is defined as one downstroke and one upstroke of said rod string, said method comprising the steps of:

generating a dynamometer card of said beam pump cycle;

obtaining a target rod load over a top or bottom of said dynamometer card;

operating said beam pump cycle while measuring rod load to obtain a measured rod load;

comparing said measured rod load against said target rod load;

instantaneously varying a driver speed for varying a surface linear speed of said rods, wherein varying said driver speed comprises at least one of slowing the driver when rod loading is above said target rod load and speeding the driver when rod loading is below said target rod load:

wherein said steps of comparing and instantaneously varying are implemented within the same beam pump cycle.

11. The method according to claim 10 wherein:

said step of comparing comprises calculating a percentage variation of said measured rod load above or below said target rod load; and said step of varying said surface linear speed comprises adjusting said surface linear speed by a percentage amount equal to said percentage variation.

12. The method according to claim 10 wherein:

said step of obtaining a target rod load comprises selecting a horizontal or inclined line.

13. The method according to claim 10 wherein:

said step of comparing comprises calculating a percentage variation of said measured rod load above or below said target rod load; and said step of instantaneously varying said surface linear speed comprises adjusting said surface linear speed by a percentage amount equal to said percentage variation multiplied by a factor.

* * * * *